US005979699A

United States Patent [19]

Simpson

[11] Patent Number: 5,979,699

[45] Date of Patent: Nov. 9, 1999

[54] DISPENSER BOX

[76] Inventor: Raymond Simpson, 1139 S. Grove, Oak Park, Ill. 60304

[21] Appl. No.: 08/999,846

[22] Filed: Oct. 9, 1997

[51] Int. Cl.[6] ..... A47K 10/24

[52] U.S. Cl. ..... 221/52; 221/60

[58] Field of Search ..... 221/52, 59, 60, 221/58, 63, 46, 45, 48; 206/445, 812

[56] References Cited

U.S. PATENT DOCUMENTS

| | | | |
|---|---|---|---|
| 2,027,671 | 1/1936 | Broeren | 221/59 |
| 2,237,424 | 7/1941 | Hope | 221/48 |
| 2,253,742 | 4/1941 | West et al. | 221/52 |
| 4,993,590 | 2/1991 | Windorski | 221/46 |
| 5,165,570 | 11/1992 | Windorski et al. | 221/46 |
| 5,363,985 | 11/1994 | Cornell | 221/59 |
| 5,390,820 | 2/1995 | Wright et al. | 221/52 |

*Primary Examiner*—Kenneth W. Noland
*Attorney, Agent, or Firm*—Jonathan E. Grant; Grant Patent Services

[57] ABSTRACT

The present invention discloses a dispenser box allowing for the removal of individual coupons without the chance of another coupon being removed at the same time. The dispenser comprises walls defining a cavity adapted to receive the stack of sheets, a rectangular flat top wall having an opening through which the sheets may be individually dispensed, a flat bottom wall having approximately the same dimensions as the flat top wall, with the flat bottom wall being approximately parallel to the flat top wall, and resilient means to push the stack of said sheets to the opening in the top wall of the dispenser.

32 Claims, 2 Drawing Sheets

DISPENSER BOX

BACKGROUND OF THE INVENTION

1. Field of the Invention

The present invention discloses a dispenser box allowing for the removal of individual coupons without the chance of another coupon being removed at the same time.

2. Description of the Prior Art

Over the years, there have been many dispenser boxes developed for the dispensing of sheets of paper or coupons of some sort. This type of device has become more important in the market place as grocery and other stores have installed coupon dispensers on their shelves to give consumers incentives to make impulse purchases based on lower prices given at their stores on any given day of the week.

To accommodate consumer needs, there has been a number of different paper dispensing devices over the years.

U.S. Pat. No. 2,253,742 (W. H. West et al.) discloses a dispenser for interfolded paper. The dispenser comprises a vertically disposed container having a dispensing opening and a spring-actuated follower plate in the container adapted to support a vertically disposed stack of interfolded paper sheets. A plate is secured to the under side of the cover at one side of the dispensing opening, and engages the upper end of the stack while maintaining a predetermined spacing between the stack and the dispensing opening. A second plate is secured to the underside of the cover, the ends of the plates adjacent the dispensing opening being rounded to form deflecting surfaces.

U.S. Pat. No. 5,390,820 (Wright et al.) discloses an elevating dispensing device for flexible sheet material. The dispensing aperture has flaps to retain the end of successively drawn sheets above the aperture for ease of withdrawal. The stack of sheets rests within the carton on an elevating platform which is flexibly attached on two opposing sides to the base of the adjacent side walls of the carton by flexibly folded extension panels which allow upward urging of the elevating platform.

U.S. Pat. No. 2,237,424 (S. N. Hope) discloses a sheet dispenser comprising a casing adapted to contain a pack of interfolded sheets and having opposite end walls with inwardly directed embossments adjacent to the opposite sides of the casing. A pair of cover members extend between the casing end walls and having end walls with outwardly directed embossments adapted to register with the casing embossments. A coiled spring for each cover member urges the cover member against the pack, with the spring surrounding a cooperating pair of the embossments on the casing and cover member.

U.S. Pat. Nos. 4,993,590 (Windorski), and U.S. Pat. No. 5,165,570 (Windorski et al.) are for dispensers for a stack of partially adhesive coated sheets stacked with the adhesive coating on each successive sheet disposed along alternate opposite sides of the stack and releasably adhering the sheets together.

In U.S. Pat. No. 4,993,590, the dispenser for adhesive coated sheets has opposed end surfaces having parallel upper ends adapted to be engaged by the opposite sides of the stack with the with the top sheets in the stack parallel to the adjacent upper ends, with the opposed end surfaces diverging slightly from each other toward the upper ends of the end surfaces to cause movement of the end portions of the stack along the end surfaces toward the upper ends in response to forces applied to the stack to sequentially remove sheets from the stack through the opening.

SUMMARY OF THE INVENTION

The dispenser of the present invention discloses a low cost dispenser which allows coupons or pieces of paper to be individually removed without the chance of another coupon being removed at the same time. In one proposed use of the invention, the sheets are coupons, and the dispenser is placed in a supermarket, on a shelf, where consumers would remove coupons to get discounts on particular grocery products when they go to the cashier's counter.

In the proposed invention, there is no "divergence" of any possible equivalent end surfaces. The surfaces of the proposed invention are all either perpendicular or parallel to each other, except for the semi-circular piece of styrene that keeps pressure on the coupons so that they stay up against the opening of the box for easy withdrawal from the dispenser. In one embodiment of the invention, the inside of the dispenser is a triangular shape that assists the semi-circular piece of styrene in keeping an upward pressure on the coupons which helps the coupons "sit up" in the dispenser box to allow them to be easily pulled out by a folded edge of the coupon.

In another one embodiment of the invention, the design of the dispenser allows it to be printed, die-cut and folded out of one piece of paper stock.

In yet another embodiment of the invention, the dispenser contains a header piece for hanging on the store shelf and for adding graphics. This header piece can be located on several other panels of the dispenser box.

In another embodiment of the invention, the dispenser may be part of an in-store display. The dispenser may also be part of an in-store easel.

In the store where the dispenser box is to be used, two dispenser boxes can be put back-to-back so that coupons can be pulled from both sides.

DESCRIPTION OF THE PREFERRED EMBODIMENT

Figure 1:
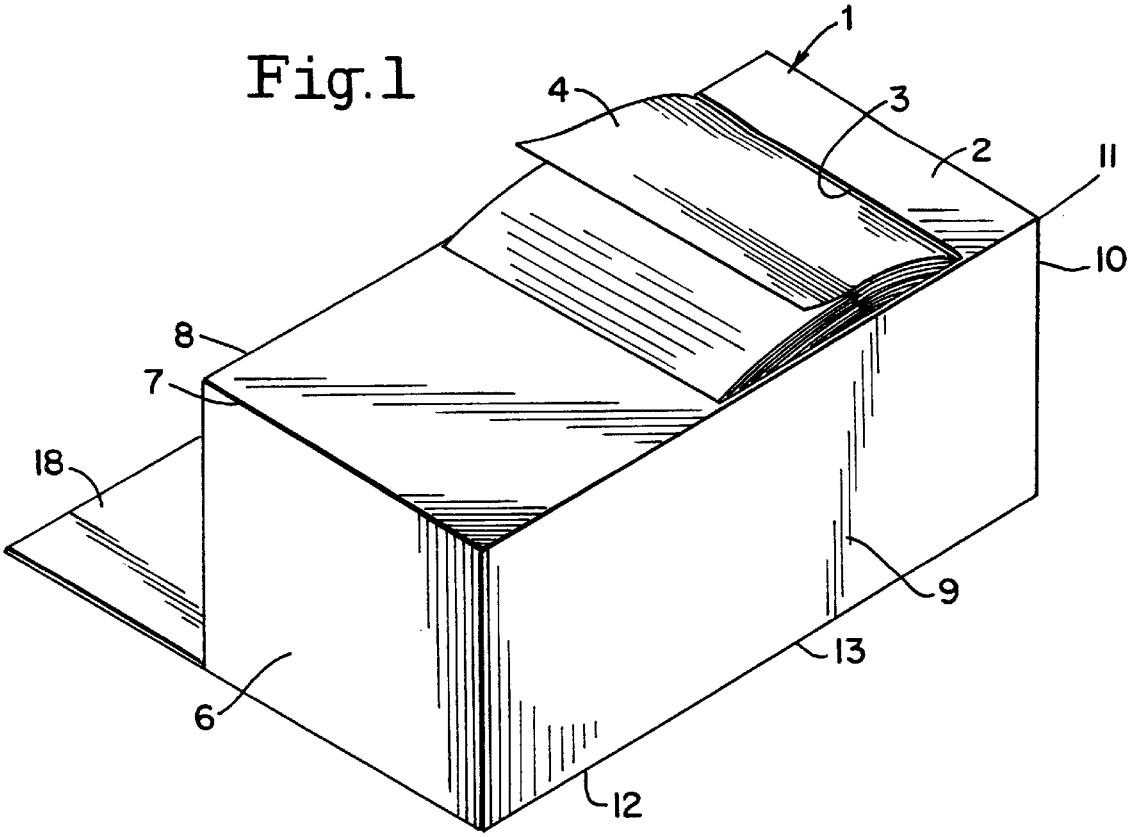
FIG. 1 is a perspective view of the coupon dispenser.
Figure 2:
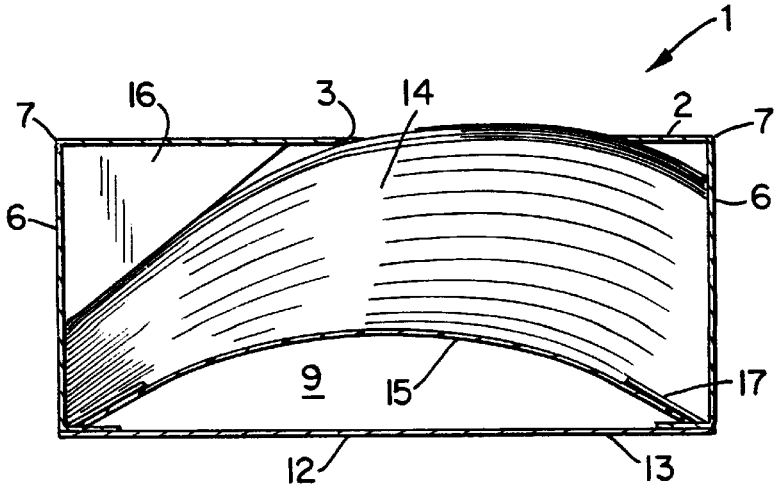
FIG. 2 is a cross-sectional view of the coupon dispenser.
Figure 3:
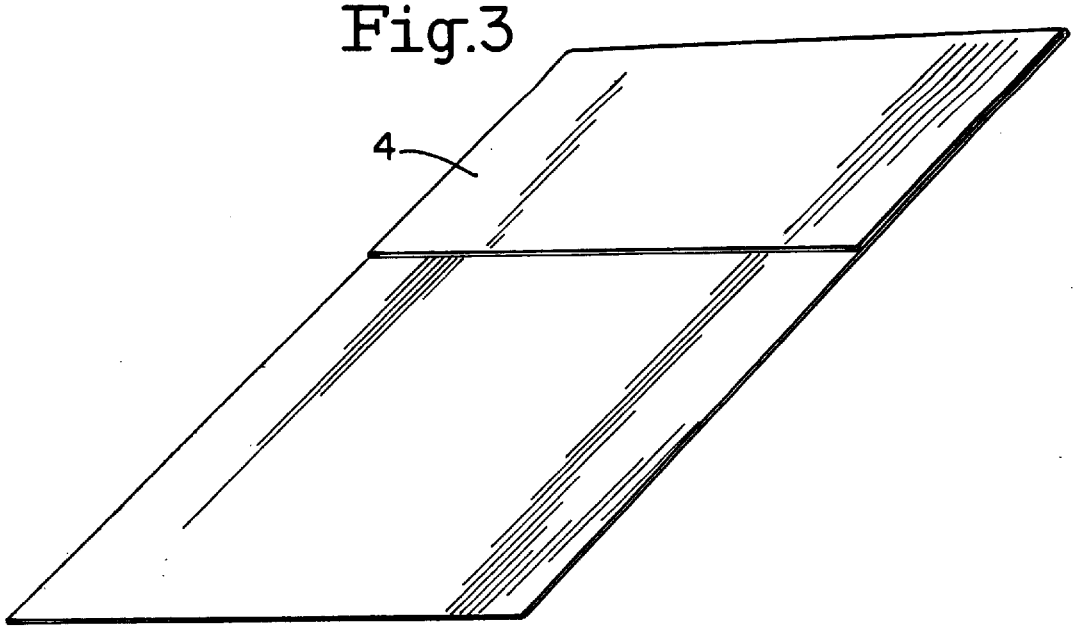
FIG. 3 is a perspective view of one of the coupons.
Figure 4:
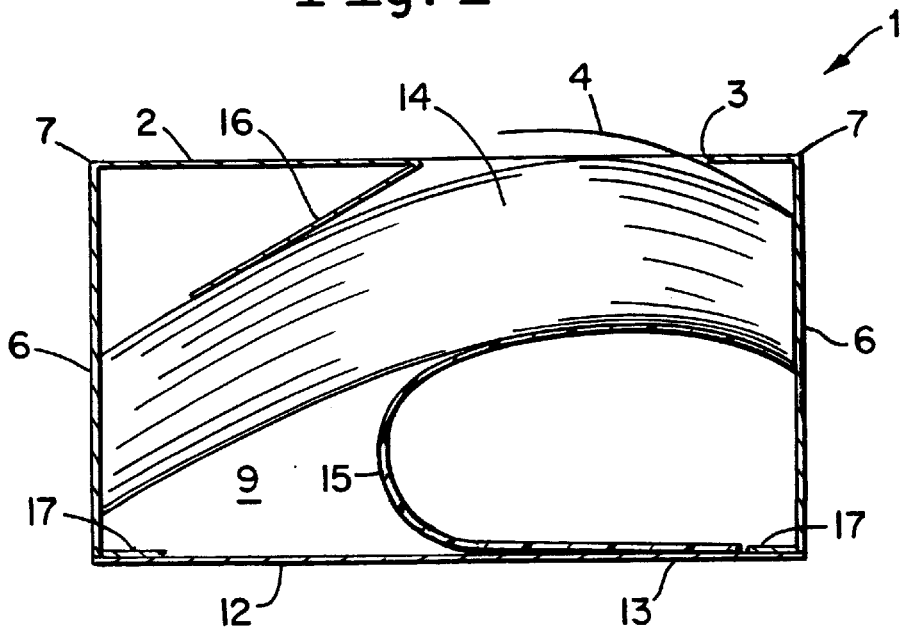
FIG. 4 is a cross-sectional view of the coupon dispenser.

Referring to FIGS. 1–4, the dispenser 1 comprises a top section 2 having an opening 3 through which coupons or flexible sheets 4 may be dispensed. The dispenser has a stack of flexible sheets disposed one on top of another and folded at a specific length, allowing for the dispensing of individual sheets.

The walls of the dispenser define a cavity 5 adapted to receive the stack of sheets. The dispenser 1 is generally rectangular or box shaped, having a large enough interior area to store a number of sheets or coupons 4. A rectangular flat top wall 3 has an opening 3 through which the sheets 4 may be individually dispensed.

The dispenser 1 has two short flat end walls 6. Edges 7 of these short flat end walls 6 are positioned perpendicularly to edges 8 of the width of the flat top wall 2 at opposite ends of the flat top wall 2. The two short flat end walls 6 are parallel to each other, with each of the two short flat end walls 6 having the same dimensions as the other flat end wall.

Between the two short flat end walls 6 are two long flat side walls 9. The edges 10 of each of the two long flat side walls 9 are positioned along the edges of the length 11 of the top wall 2 with the long flat side walls 9 positioned perpendicularly to the flat top wall 2. Each of the long side walls 9 are located on opposite sides of the width of the top wall 2, such that the two long side walls 9 are parallel to each other.

The dispenser 1 also has a flat bottom wall 12 having approximately the same dimensions as the flat top wall 2, without an opening. The flat bottom wall 12 is approximately parallel to the flat top wall 2, wherein one edge 13 along the length of the flat bottom wall is affixed to the bottom of the dispenser 1. The stack of sheets 14 is positioned between the two short end walls 6.

In a preferred embodiment of the invention, a resilient means is used to push the stack of sheets 14 up to the opening 3 in the top wall 2 of the dispenser 1. In one embodiment of the invention, the means to push the sheets to the opening of the dispenser is an arc type structure 15 positioned underneath the stack of sheets 14. This arc type structure 15 is positioned between the short end walls 6 and above the flat bottom wall 12. The peak of the arc type structure 15 is in communication with the stack of sheets 14, pushing the stack of sheets 14 towards the opening 3 in the dispenser 1. In another embodiment of the invention, the arc type structure 15 may be flexed and inserted between the stack of sheets 14 and the bottom wall 12.

Another preferred feature of the dispenser directs the stack of sheets towards the opening in the top wall of the dispenser. More preferably, this feature is an angular formation 16 positioned between one of the end walls 6 and the top wall 2, to direct the stack of sheets 14 towards the opening 3 in the top wall 2 of the dispenser 1. Preferably, this angular formation 16 is a triangular shaped piece 16 positioned between the end wall 6 and the top wall 2. This triangular shaped piece is most preferably in the form of a right trangle which fits into one of the top corners of the dispenser 1. In a more preferable embodiment of the invention, the angular formation 16 is the material from opening 3 folded back toward wall 6.

The exterior walls of the dispenser 1 may be made out of one unitary piece of material wherein the material is selected from the group consisting of paper, styrene, and plastic. In line with this arrangement, it is a preferred embodiment to have flaps or tongues 17 on one edge of each wall so that the unitary piece of material may be folded into the box like dispenser. In such an arrangement, the bottom wall of the device may be secured in place to an overlapping flap or tongue by means of an adhesive of some sort such as tape or glue. In yet another embodiment of the invention, the box may have slits 17 into which the flaps or tongues are inserted to hold the dispenser 1 in its box-like shape.

The dispenser may also have a header 18 for displaying the dispenser 1. This header 18 may be positioned along virtually any wall or edge of the dispenser 1 but it is most preferable to have th header positioned along the same plane as that of the bottom section 12, to allow for the display of the dispenser 1.

Many modifications and variations of the present invention are possible in light of the above teachings. It is, therefore, to be understood within the scope of the appended claims the invention may be protected otherwise than as specifically described.

What is claimed is:

1. A dispenser for flexible sheets from a stack of sheets disposed one said sheet on top of another, allowing for the dispensing of individual sheets, said dispenser comprising:

walls defining a cavity adapted to receive the stack of said sheets, said walls including:

a rectangular flat top wall having an opening through which said sheets may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

a resilient flexible arc type structure said arc type structure having essentially a solid rectangular shape when flat, said arc type structure pushing said stack of said sheets to the opening in the top wall of the dispenser, said arc type structure positioned underneath said stack of sheets, said arc type structure positioned between said short flat end walls and above said flat bottom wall, wherein said arc type structure is in communication with said stack of sheets, pushing said stack of sheets towards the opening in said flat top wall;

said stack of said sheets being positioned between said two short end walls within said dispenser and wherein each said flexible sheet from said stack of sheets is disposed one said flexible sheet on top of another said flexible sheet, each said flexible sheet being independent from one another and folded upon itself at a specific length, allowing for the dispensing of individual sheets.

2. The dispenser of claim 1, further comprising a means for directing said stack of said sheets towards the opening in the top wall of the dispenser.

3. The dispenser of claim 1, further comprising an angular formation positioned between one of said end walls and said top wall, for the purpose of directing said stack of said sheets towards said opening in the top wall of the dispenser.

4. The dispenser of claim 3, further comprising a triangular shaped piece positioned between one of said end walls and said top wall, for the purpose of directing said stack of said sheets towards said opening in the top wall of the dispenser.

5. The dispenser of claim 3, wherein said angular formation is the material from said opening folded back toward said said wall.

6. The dispenser of claim 1, wherein said dispenser is made of one unitary piece of material aside from the arc type structure.

7. The dispenser of claim 1, wherein said dispenser is comprised of a material selected from the group consisting of paper, styrene, and plastic.

8. The dispenser of claim 1, further comprising a header for displaying said dispenser.

9. The dispenser of claim 1, wherein said sheets are coupons.

10. The dispenser of claim 1, wherein the apex of said arc type structure is in communication with the bottom of said stack of sheets.

11. The dispenser of claim 1, wherein one side of end of said arc type structure is in communication with the bottom of said stack of sheets, wherein said apex of said arc type structure is facing one of said side walls.

12. A dispenser for flexible sheets from a stack of sheets disposed one on top of another, allowing for the dispensing of individual sheets, said dispenser comprising:

walls defining a cavity adapted to receive the stack, said walls including:

a rectangular flat top wall having an opening through which said sheets may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

a resilient element to push said stack of said sheets to the opening in the top wall of the dispenser, said means being an arc type structure positioned underneath said stack of sheets and between said stack of sheets and the flat bottom wall, wherein one end of said arc type structure is in communication with said stack of sheets, pushing said stack of sheets towards the opening in said flat top wall;

an angular formation positioned between one of said end walls and said top wall, for the purpose of directing said stack of said sheets towards said opening in the top wall of the dispenser, wherein said angular formation is the material from said opening folded back toward said wall, and wherein said stack of said of sheets is positioned between said two short end walls within said dispenser.

13. A dispenser for flexible sheets from a stack of sheets disposed on top of another, allowing for the dispensing of individual sheets, said dispenser comprising:

walls defining a cavity adapted to receive the stack, said walls including:

a rectangular flat top wall having an opening through which said sheets may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser; and side flaps positioned on a bottom section of at least one of said walls, wherein said stack of said sheets is positioned between said two short end walls within said dispenser.

14. The dispenser of claim 13, further comprising a resilient element to push said stack of said sheets to the opening in the top wall of the dispenser, said element being an arc type structure positioned underneath said stack of sheets and between said stack of sheets and the flat bottom wall, wherein one end of said arc type structure is in communication with said stack of sheets, pushing said stack of sheets towards the opening in said flat top wall.

15. A dispenser for dispensing flexible sheets from a stack of sheets disposed on top of one another, allowing for the dispensing of individual sheets, said dispenser comprising:

walls defining a cavity adapted to receive the stack, said walls including:

a rectangular flat top wall having an opening through which said sheets may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

a resilient flexible arc type structure, said arc type structure having essentially a rectangular shape when flat, said arc type structure pushing said stack of said sheets to the opening in the top wall of the dispenser, said arc type structure positioned underneath said stack of sheets, said arc type structure positioned between said short flat end walls and above said flat bottom wall, wherein one end of said arc type structure is in communication with said stack of sheets, pushing said stack of sheets towards the opening in said flat top wall; and wherein each said flexible sheet from said stack of sheets is disposed one said flexible sheet on top of another said flexible sheet, and said stack of said sheets is positioned between said two short end walls within said dispenser, and further that each said sheet is independent from one another and folded upon itself at a specific length, allowing for the dispensing of individual sheets.

16. The dispenser of claim 15, further comprising an angular formation positioned between one of said end walls and said top wall, for the purpose of directing said stack of said sheets towards said opening in the top wall of the dispenser.

17. The dispenser of claim 16, further comprising a triangular shaped piece positioned between on of said end walls and said top wall, for the purpose of directing said stack of said sheets towards said opening in the top wall of the dispenser.

18. The dispenser of claim 16, wherein said angular formation is the material from said opening folded back toward said wall.

19. The dispenser of claim 15, wherein said dispenser is made of one unitary piece of material.

20. A dispenser for dispensing flexible sheets from a stack of sheets disposed one on top of another, allowing for the dispensing of individual sheets, said dispenser comprising:

flexible sheets, each said flexible sheet being independent from each other, and each said sheet being folded upon itself at a specific length, allowing for the dispensing of individual sheets with ease;

walls defining a cavity adapted to receive the stack, said walls including:

a rectangular flat top wall having an opening through which said sheets may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall;

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser; and resilient element to push said stack of said sheets to the opening in the top wall of the dispenser; and wherein said stack of said sheets is positioned between said two short end walls within said dispenser.

21. The dispenser of claim 20, wherein said element to push said stack of said sheets to the opening in the top wall of the dispenser is an arc type structure positioned underneath said stack of sheets, said arc type structure positioned between said short flat end walls and above said flat bottom wall, wherein said arc type structure is in communication with said stack of sheets, pushing said stack of sheets towards the opening in said flat top wall.

22. The dispenser of claim 20, wherein the element to push said stack of said sheets to the opening in the top wall of the dispenser is an arc type structure positioned underneath said stack of sheets, said arc type structure positioned between said stack of sheets and above said flat bottom wall, wherein one end of said arc type structure is in communication with said stack of sheets, pushing said stack of sheets towards the opening in said flat top wall.

23. The dispenser of claim 20, further comprising directing said stack of said sheets towards the opening in the top wall of the dispenser.

24. The dispenser of claim 23, further comprising an angular formation positioned between one of said end walls and said top wall, for the purpose of directing said stack of said sheets towards said opening in the top wall of the dispenser.

25. The dispenser of claim 24, further comprising a triangular shaped piece positioned between one of said end walls and said top wall, for the purpose of directing said stack of said sheets towards said opening in the top wall of the dispenser.

26. The dispenser of claim 25, wherein said angular formation is the material from said opening folded back toward said wall.

27. The dispenser of claim 20, wherein said dispenser is made of one unitary piece of material.

28. The dispenser of claim 20, further comprising side flaps positioned on a bottom section of at least one of said walls.

29. The dispenser of claim 20, further comprising a header for displaying said dispenser.

30. A method for dispensing a sheet from a stack of sheets disposed one top of one another, allowing for the dispensing of individual sheets, comprising:

folding each said sheet upon itself at a specific length, each sheet becoming a flexible folded sheet;

stacking each said flexible folded sheet such that each said flexible folded sheet is stacked one said flexible folded sheet top of another said flexible folded sheet;

inserting said stack of flexible folded sheets into a dispenser, said dispenser comprising:

walls defining a cavity adapted to receive the stack, said walls including:

a rectangular flat top wall having an opening through which said sheets may be individually dispensed;

two short flat end walls, wherein edges of each of said two short flat end walls are positioned perpendicularly to edges of the width of said flat top wall at opposite ends of said flat top wall, wherein said two short flat end walls are parallel to each other and each said short flat end wall has the same dimensions as the other flat end wall:

two long flat side walls wherein edges of each of said two long flat side walls are positioned perpendicularly to edges of the length of said flat top wall at opposite sides of said flat top wall, wherein said two long flat side walls are parallel to each other and each said long flat side wall has the same dimensions as the other long flat side wall;

a flat bottom wall having approximately the same dimensions as the flat top wall, said flat bottom wall being approximately parallel to said flat top wall, wherein at least one edge along the length of said flat bottom wall is affixed to the bottom of said dispenser;

a resilient member for pushing said stack of said sheets to the opening in the top wall of the dispenser, said resilient member positioned between said short flat end walls and above said flat bottom wall; and pulling on a single said folded sheet emerging from the top of said opening in said dispenser, thereupon allowing for the dispensing of the sheet.

31. The method of claim 30, wherein said sheets are coupons.

32. The method of claim 30, wherein said resilient element is an arc type structure positioned underneath said stack of said folded sheets and between said stack of said folded sheets and the flat bottom wall, wherein one end of said arc type structure is in communication with said stack of sheets, pushing said stack of sheets towards the opening in said flat top wall.

* * * * *